United States Patent [19]

Nestegard

[11] Patent Number: 4,684,121

[45] Date of Patent: Aug. 4, 1987

[54] MULTIPLE EXERCISE UNIT

[76] Inventor: Sander C. Nestegard, 175 Galtier Pl., Shoreview, Minn. 55126

[21] Appl. No.: 927,535

[22] Filed: Nov. 5, 1986

[51] Int. Cl.[4] ..... A63B 69/18

[52] U.S. Cl. ..... 272/97; 272/72

[58] Field of Search ..... 272/70, 72, 97, 136, 272/142

[56] References Cited

U.S. PATENT DOCUMENTS 1,750,549 3/1930 Thomson et al. ..... 272/142 X 3,261,606 7/1966 Elia et al. ..... 272/72

3,770,267 11/1973 McCarthy ..... 272/142 X 4,618,139 10/1986 Haaheim ..... 272/97 X 4,632,385 12/1986 Geraci ..... 272/70

*Primary Examiner*—Andrew V. Kundrat

*Attorney, Agent, or Firm*—John C. Barnes

[57] ABSTRACT

An exercise device for simulating several outdoor sports is made portable and convenient by using a rectangular frame with parallel rails and two roller members which can move independently along the rails to simulate skiing or together as a rowing seat and handle members cooperate with the respective exercise.

5 Claims, 6 Drawing Figures

MULTIPLE EXERCISE UNIT

This invention relates to an exercise device on which several different and distinct exercises can be performed and in one aspect to an exercise kit which transforms a ski simulating exerciser to a rowing simulating exerciser and a curling machine.

BACKGROUND OF THE INVENTION

This invention generally relates to an exercising device where various outdoor sporting activities can be simulated indoors. There are known exercise devices for simulating cross-country skiing. There are also known exercise devices for simulating rowing. There are other known devices for indoor exercising to exercise and develop different muscles in different parts of the body by adding parts, exchanging parts or using different parts of a basic exercise system.

The present invention comprises an exercise kit comprising a basic frame with accessory parts making the basic frame adaptable for performing different simulated outdoor sport activities. The frame is light weight. It can be easily moved and can be stored conveniently.

SUMMARY OF THE INVENTION

This invention is directed to an improved, portable, easily storable indoor exercise device for simulating outdoor activities. It comprises a kit having a main frame and related attached and attachable members for simulating several exercises, notably cross-country skiing and rowing. Other exercises to be performed are a leg press exercise and the arm curls.

The exercise kit comprises a rectangular frame having two longitudinal side members, two end members connecting the ends of said side members and two members parallel to and spaced from said side members defining with said side members two parallel longitudinal rails. A pair of roller members are formed to move along said rails and adjustable brake members cooperating between said roller members and said frame restrict rolling movement of said roller members along said frame rails. Spaced foot rest pads are positioned at one end of said frame and are fixed to one said end member. A spring member is connected at one end to the opposite end member. Handle means are connected via a cable and pulley to the other end of said spring member. A seat is adapted to be supported by said roller members for movement with said roller members on said rails when the roller members are moving in unison. A pair of arms are pivotally connected, one to each longitudinal side member, via an adjustable resistance connection to vary the force required to pivot said arms. The arms may be moved from a storage position generally parallel to the longitudinal side members to a generally vertical position simulating ski poles. Hand grips are positioned at the free ends of the arms.

The roller members will support the feet of the exerciser and are movable oppositely along the rails and the hands of the exerciser may grasp the hand grips to swing the arms to and fro about the pivot connecting means in synchronization to the movement of the roller members to simultaneously stretch the legs and move the arms to simulate cross-country skiing.

The seat may be placed to straddle the roller members. The arms will be placed in the stored position. The exerciser will sit upon the seat, resting the feet on the foot pads and by grasping and pulling on the handle against the bias of the spring member while pushing the seat away from the foot pads, the simulated rowing exercise is performed.

A leg press exercise is performed by connecting the cable to the seat to increase the force required to force the seat away from the foot pads.

An arm curling exercise is performed by grasping the handle with the palms of the hands upward and drawing the handle toward the chin.

DESCRIPTION OF THE DRAWING

The present invention will be further described with reference to the accompanying drawing wherein.

DETAILED DESCRIPTION OF THE INVENTION

Figure 1:
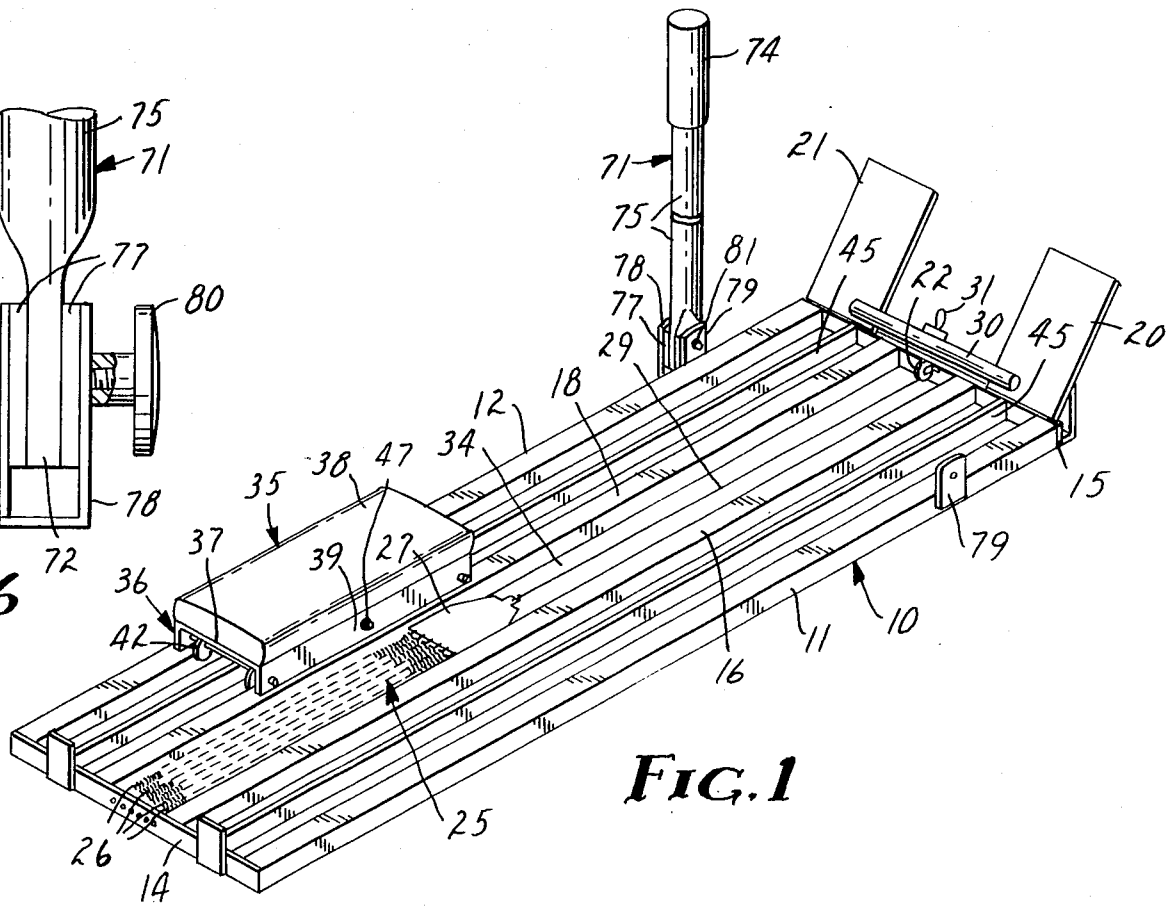
FIG. 1 is a perspective view of the frame of the exercise kit with parts removed to show the other parts.
Figure 6:
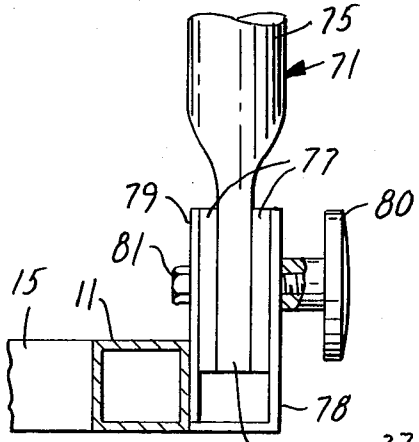
FIG. 6 is a fragmentary sectional view of the resistance pivotal support for the arms.

The present invention relates to an exercise kit for use indoors to simulate the exercise and develop the muscles used in participation in cross-country skiing outdoors and rowing. The kit also permits other exercises for the arms and legs.

The kit comprises a main frame 10 which is the shape of an elongate rectangle having longitudinal side members 11 and 12, opposite end members 14 and 15 and two members 16 and 18 which extend between the end members parallel to said side members 11 and 12 and parallel to each other to define a pair of rails extending lengthwise of the frame. Attached and positioned oblique to the end member 15 is a pair of spaced foot rest pads 20 and 21. A pulley 22 is pivotally connected to the end member 15 on the side opposite the foot pads 20 and 21.

A spring member 25 is connected at one end to the end member 14 between the two frame members 16 and 18. The spring member 25, as illustrated, comprises a plurality of horizontally disposed helical tension springs 26 connected at one end to the end member 14 and to a bracket 27 at their other end. The bracket 27 is connected to one end of a cable 29 which extends through the pulley 22 and about the wheel thereof and through a handle 30. The cable terminates in an eye 31. The eye 31 is adapted for connection to a hook 32 on a seat 60 to be hereinafter described.

The springs 26 and bracket 27 are supported by a plate 34 positioned at the bottom of the frame between frame members 16 and 18.

The side members 11 and 12 and the frame members 16 and 18 define parallel rails to support a pair of roller members 35. The roller members 35 comprise an inverted channel shaped frame 36 of rectangular appearance. The upper surface 37 of the frame 36 supports a pad 38 of upholstered foam having a fabric or vinyl covering. The depending flanges 39 of the frame 36 support a pair of transversely extending parallel shafts 40 on each of which is supported rotatably a pair of axially spaced rollers 42. The rollers 42 comprise a cylindrical member of metal having radially projecting flanges which guide the rollers 42 and roller members 35 along the rails as shown in FIG. 2.

Figure 5:
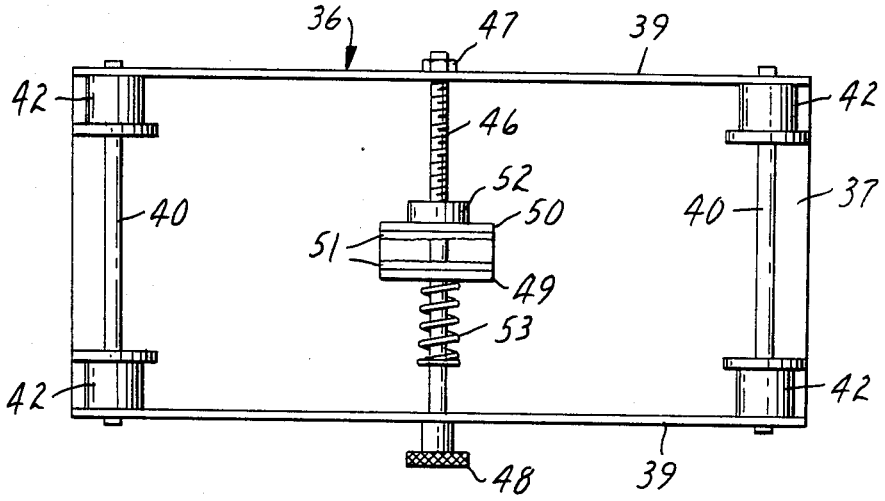
FIG. 5 is a bottom view of a roller member and the frame.

Brake means are formed between the roller members 35 and the frame 10 to restrict free, unrestrained rolling movement of said roller members 35. As shown in FIGS. 2 and 5, the brake means comprise a narrow longitudinal rib 45 extending the length of the rail and between and parallel to the side members 11 and 12 and the frame members 16 and 18. A threaded rod 46 extends through the flanges 39 of the frame 36 and has a lock nut 47 to restrict displacement of the same. A knurled handle 48 is fixed on the other end. Positioned along the rod 46 is a pair of rectangular plates 49 and 50, each having a friction covering 51 on the opposed faces to engage the rib 45. One plate 50 is fixed to a threaded nut 52 and moves along the rod upon rotation thereof, and the other plate 49 is urged against the rib 45 by a compression spring 53.

Rotation of the knurled handle 48 will loosen the frictional force of the plates 50 against the rib 45 or increase the frictional force to control the freedom of movement of the roller members 35 along the rails. Plate 49 is urged against rib 45 continuously.

Figure 2:
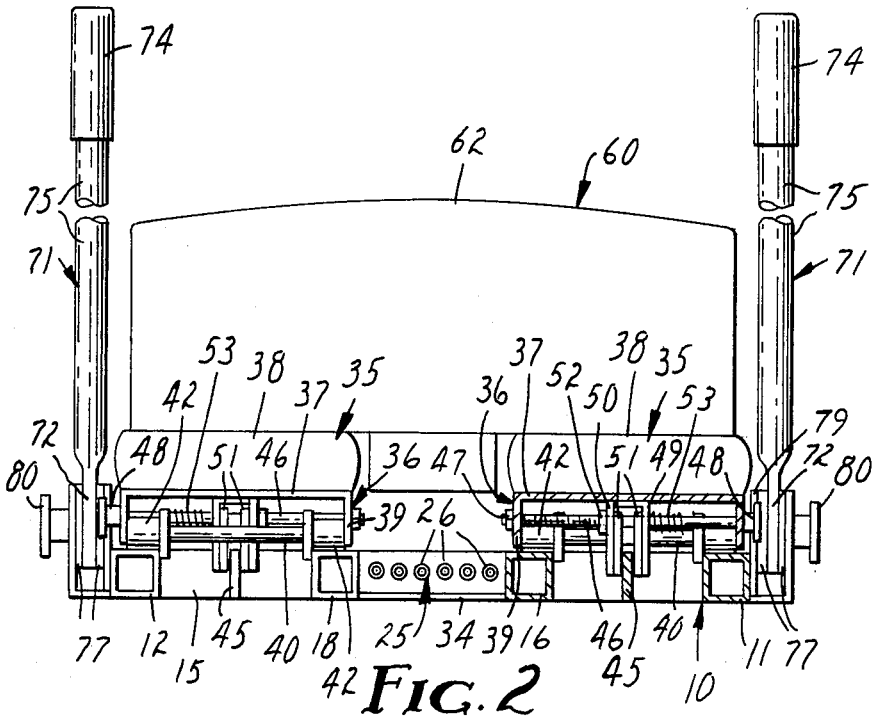
FIG. 2 is a partial transverse sectional view of the frame of FIG. 1 taken along the line 2—2 of FIG. 1, with a foot roller member and part of the seat shown.
Figure 3:
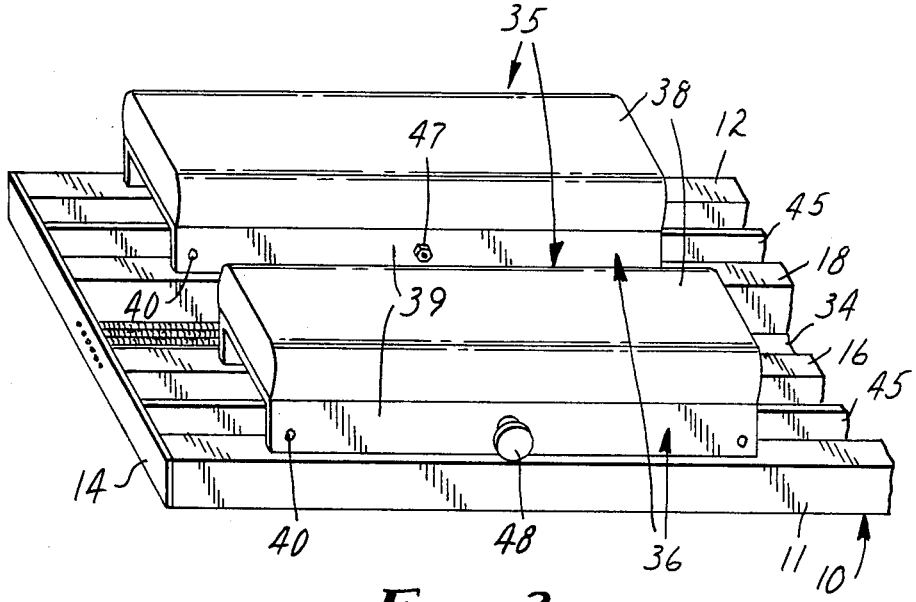
FIG. 3 is a perspective view of the foot roller members and a part of the frame.
Figure 4:
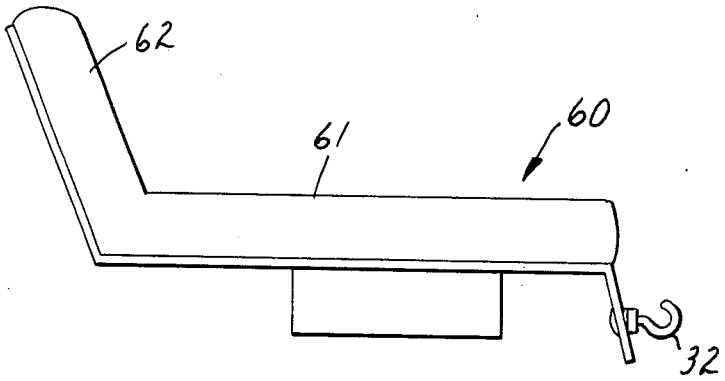
FIG. 4 is a side view of the seat.

A seat 60 comprising a padded rectangular surface 61 and back support 62 is shown in FIGS. 2 and 4. The seat is adapted to straddle both of the roller members 35 and to move in unison with the roller members to and fro along the rails. The seat 60 is provided with a hook 32 near the front edge of the seat 60 for attachment to the eye 31 on the cable 29.

An arm 71 is pivotally connected to each side member 11 and 12 of the frame 10. The arms 71 have a generally circular disc 72 at one end with a central pin receiving opening. The other end terminates in a hand grip 74. The arms include a tubular rod 75 connected to the disc 72 and the hand grip 74 fits over the opposite end of the rod. The arm 71 is between about 48 and 54 inches long. The disc 72 is provided with a friction covering 77 on each side. The covered disc is positioned between a fixed first plate 78 having an L-shape in end view with the foot of the L fixed to the side members 11 and 12. A second plate 79 of similar shape is provided with a surface to rest on the foot of plate 78. A threaded bolt 81 extends through plate 79, disc 72 and plate 78. A threaded handle 80 receives the bolt 81 and as it is threaded on the bolt, the pressure of the plates 78 and 79 against the disc 72 increases to increase the resistance to rotation of the arm 71 about the bolt 81 in relationship to the frame 10.

In use, as a cross-country skiing exerciser, the seat 60 is removed from the roller members 35. The arms 71 are raised off a pair of rests on brackets not shown on side members 11 and 12. The handles 80 are adjusted to provide the tension or resistance desired for pivoting the arms. Similarily, the resistance to movement for the roller members 35 is adjusted by turning handles 48. The feet are placed on the roller members 35 and the hands grasp the hand grips 74 of the arms 71. Exercise begins by sliding the roller members 35 to and fro, along the rails and simultaneously swinging the arms 71 in the manner of alternately sliding the skis and moving the poles.

To perform the rowing exercise, the handles 80 are loosened and the arms 71 are positioned parallel to the frame. The roller members are aligned on the rails and the seat is returned to a position across both roller members. By sitting on the seat and placing the feet on the rest pads 20 and 21, the position is assumed and the exercise begins by grasping the handle 30 with the palms of the hands down and drawing the handle toward the body while simultaneously pushing the seat away from the foot rest pads 20 and 21 by straightening the legs. As the tension in the springs is released slowly the legs are bent, bringing the seat and roller members forward.

A leg press exercise is performed by drawing the seat 60 and roller members toward the foot rests 20 and 21 and connecting the eye 31 of the cable to the hook 32 at the front of the seat. By straightening and bending the legs under the tension of the springs 26, the seat is moved back and forth, along with the roller members 35 along the rails.

By releasing the eye 31 from the hook 32 on the seat 60 and grasping the handle 30 with both hands, having the palms up, the arms may be bent toward the chin, tensioning the springs 26 and exercising the arms.

Having thus described the present invention with reference to a preferred embodiment, it will be appreciated that modifications can be made without departing from the scope or spirit of the present invention as defined by the appended claims.

What is claimed is:

1. An exercise device for simulating the exercise from various sports and for performing various exercises on various muscles of the body, said device comprising:

a rectangular frame, said frame having two longitudinal side members, two members parallel to and spaced from said side members defining a pair of longitudinally extending rails, and two end members, roller member means mounted on said rails for rolling movement therealong and for support of the feet of the operator, brake means on said roller member means and said rails for resisting rolling movement of said roller member means along said rails, arm means attached to said longitudinal side members for pivotal movement in relationship to said side members, said arm means having a length to permit grasping when standing on said roller member means, and resistance means for varying the force necessary to pivot said arm means in a simulated cross-country skiing exercise, foot braces on one of said end members, a pulley positioned between said foot braces, spring means disposed between said rails and fixed to the other of said end members, and a handle and cable connected to said spring means and to said pulley to afford a rowing exercise and arm curls.

2. A device according to claim 1 wherein said resistance means to vary the force necessary to pivot said arm means comprises a pair of opposed plates having a coating material to increase the friction between said plates and an end of said arm means.

3. A device according to claim 1 comprising seat means for joining said roller member means for movement in unison along said rails.

4. A device according to claim 3 wherein said seat means for joining said roller member means comprises a seat which straddles said roller member means and rests on said roller member means.

5. A device according to claim 4 wherein said seat has hook means for connecting to said cable to attach said spring means to said seat for resisting movement of said seat on said roller member means in a direction away from said foot braces.

* * * * *